US005747155A

United States Patent [19]

Miller, Jr. et al.

[11] Patent Number: 5,747,155

[45] Date of Patent: May 5, 1998

[54] SMEAR AND SCRATCH RESISTANT THERMALLY TRANSFERABLE PRINTING RIBBONS AND METHODS OF MAKING THE SAME

[75] Inventors: Thomas C. Miller, Jr., Kettering; Thomas J. Obringer, Vandalia, both of Ohio

[73] Assignee: NCR Corporation, Dayton, Ohio

[21] Appl. No.: 795,460

[22] Filed: Feb. 4, 1997

Related U.S. Application Data

[63] Continuation of Ser. No. 504,197, Jul. 19, 1995, abandoned.

[51] Int. Cl.[6] ..... B41M 5/26

[52] U.S. Cl. ..... 428/327; 428/206; 428/331; 428/447; 428/484; 428/488.4; 428/500; 428/913; 428/914

[58] Field of Search ..... 428/195, 484, 428/488.4, 447, 488.1, 500, 521, 206, 323, 327, 331, 913, 914

[56] References Cited

U.S. PATENT DOCUMENTS 5,045,383 9/1991 Maeda et al. ..... 428/216

5,178,930 1/1993 Sakai et al. ..... 428/195

5,250,346 10/1993 Nagai et al. ..... 428/195

5,266,382 11/1993 Tuyuguchi et al. .

5,290,623 3/1994 Kawahito et al. .

*Primary Examiner*—Pamela R. Schwartz

*Attorney, Agent, or Firm*—Craig E. Miller

[57] ABSTRACT

Smear and scratch resistant thermally transferable printing ribbons and methods of making the same consisting of elongated backing elements having thermally transferable printing media adhered to one side thereof. The thermally transferable printing media preferably consists of two layers, a sub coat layer and a print layer, and is capable of being transferred to paper, or some other print receiving media, by conventional thermal transfer printing equipment. The use of a silicon compound and/or ethylene bisstearamide and/or micronized polyethylene in the sub coat layer provides enhanced smear and scratch resistance in thermally transferred printed images while maintaining the advantage of low thermal energy print transfer.

16 Claims, 1 Drawing Sheet

SMEAR AND SCRATCH RESISTANT THERMALLY TRANSFERABLE PRINTING RIBBONS AND METHODS OF MAKING THE SAME

This is a continuation of application Ser. No. 08/504,197 filed on Jul. 19, 1995, now abandoned.

BACKGROUND AND SUMMARY OF THE INVENTION

The present invention relates generally to new and novel improvements in thermally transferable printing ribbons and methods of making the same. More particularly, the present invention relates to thermally transferable printing ribbons and methods of making the same characterized by low thermal energy print transfer properties and enhanced thermally transferred printed image smear and scratch resistance.

One characteristic which is important in thermal transfer printing operations is the smear and scratch resistance of the thermally transferred printed image. One method of achieving higher smear and scratch resistance of a thermally transferred printed image is to increase the melting point of the thermally transferable printing ribbon printing media. However, another desirable characteristic of thermally transferable printing ribbons is a relatively low melt temperature to provide for low thermal energy printed image transfer. In general, low melting temperature thermally transferable printing ribbons currently available do not exhibit good smear and scratch resistance, particularly when printed upon coated receiver stocks.

Accordingly, an object of the present invention is the provision of smear and scratch resistant thermally transferable printing ribbons and methods of making the same having a thermally transferable printing media with a relatively low melting temperature.

Another object of the present invention is to provide smear and scratch resistant thermally transferable printing ribbons and methods of making the same with low thermal energy print transfer characteristics.

Still another object of the present invention is to provide smear and scratch resistant thermally transferable printing ribbons and methods of making the same which are capable of creating thermally transferred printed images having good smear and scratch resistance.

Yet another object of the present invention is to provide smear and scratch resistant thermally transferable printing ribbons and methods of making the same which are capable of creating thermally transferred printed images having good smear and scratch resistance when printed upon coated receiver stock materials.

These and other objects of the present invention are attained by the provision of smear and scratch resistant thermally transferable printing ribbons and methods of making the same consisting of elongated backing elements having thermally transferable printing media adhered to one side thereof. The thermally transferable printing media preferably consists of two layers, a sub coat layer and a print layer, and is capable of being transferred to paper, or some other print receiving media, by conventional thermal transfer printing equipment. The use of a silicon compound and/or ethylene bisstearamide and/or micronized polyethylene in the sub coat layer provides enhanced smear and scratch resistance in thermally transferred printed images while maintaining the advantage of low thermal energy printed image transfer.

Other objects, advantages and novel features of the present invention will become apparent in the following detailed description of the invention when considered in conjunction with the accompanying drawings.

DETAILED DESCRIPTION OF THE DRAWINGS

Figure 1:
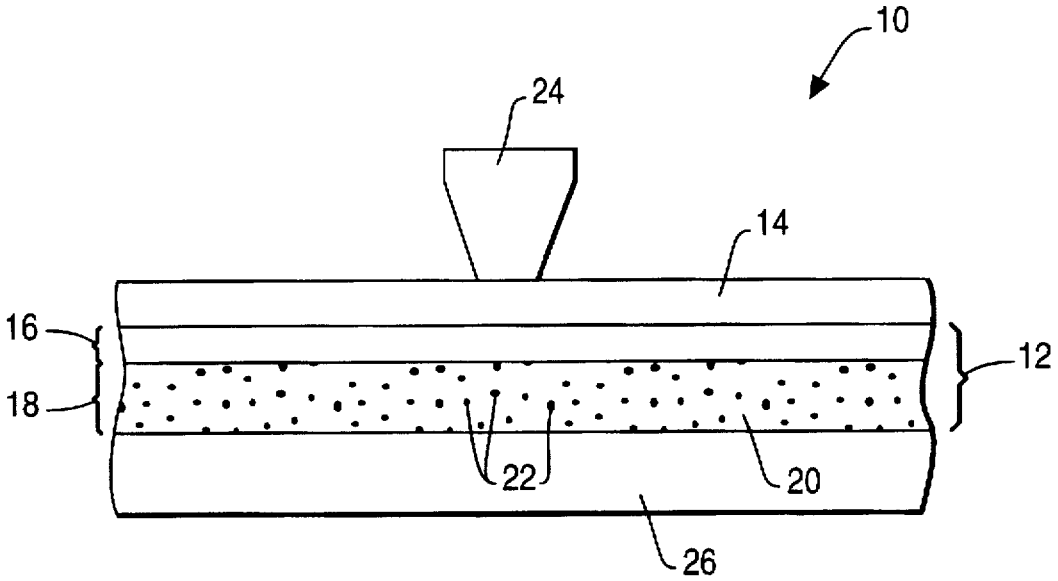
FIG. 1 is a cross-sectional side view of a preferred embodiment of a smear and scratch resistant thermally transferable printing ribbon showing a conventional thermal transfer print head transferring a thermally transferred printed image from the smear and scratch resistant thermally transferable printing ribbon to a print receiving medium in accordance with the present invention.
Figure 2:
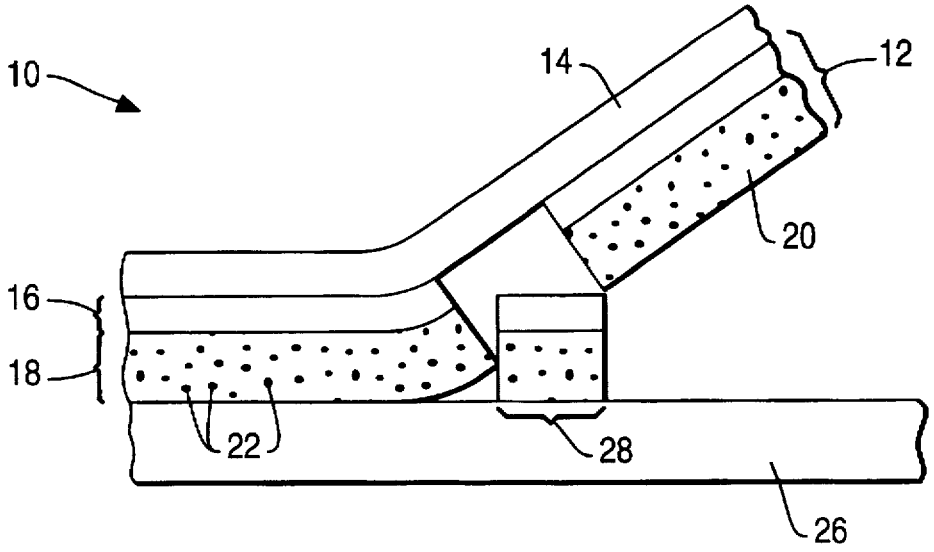
FIG. 2 is a cross-sectional side view of the thermally transferred printed image or character formed from the preferred embodiment of smear and scratch resistant thermally transferable printing ribbon shown in FIG. 1 fixed upon the print receiving medium.

Referring now to the drawings, in which like-referenced characters indicate corresponding elements throughout the several views, attention is drawn to FIGS. 1 and 2 which illustrate a first preferred embodiment of a smear and scratch resistant thermally transferable printing ribbon in accordance with the present invention, generally identified by reference numeral 10. Smear and scratch resistant thermally transferable printing ribbon 10 consists of thermally transferable printing media 12 which is adhered to one side of elongated backing element 14. Thermally transferable printing media 12 includes sub coat layer 16 adhered to one side of elongated backing element 14 and printing layer 18 adhered to sub coat layer 16 distal from elongated backing element 14. Elongated backing element 14 is preferably a long narrow strip of a flexible polymeric material, most preferably a polyester film such as Mylar, available from E. I. Dupont de Nemours & Co., Incorporated in Wilmington, Del. Elongated backing element 14 should be compatible with thermally transferable printing media 12, and preferably has sufficient tensile strength to resist tearing, while being sufficiently flexible to be wound around a spool or reel.

In the preferred embodiment shown, sub coat layer 16 of thermally transferable printing media 12 includes one or more of a silicon compound, ethylene bisstearamide and micronized polyethylene, in combination with micronized waxes and resins/binders. Printing layer 18 of thermally transferable printing media 12 includes a functional coating of waxes and/or resins and pigments and/or inks. In the preferred embodiment of smear and scratch resistant thermally transferrable printing ribbon 10, printing layer 18 consists of binding substrate 20, a formulation of waxes and/or resins, having an interspersed distribution of black or colored pigments 22. Printing layer 18 is applied to the surface of sub coat layer 16 distal from elongated backing element 14 to form smear and scratch resistant thermally transferable printing ribbon 10.

It will be recognized by those having ordinary skill in the relevant art that other pigments or inks could be substituted, or added, to black or colored pigments 22 in binding substrate 20. For example, magnetic identification character recognition (MICR) pigments could be added to allow automated machine reading of the thermally transferred printed images and characters. In addition, fluorescent pigments or inks could be added, or substituted, for black or colored pigments 22 to permit "security" markings or thermally transferred printed images which fluoresce, and become visible, when exposed to light having wavelengths in the ultraviolet spectrum. It should be recognized that various combinations of pigments and/or inks could be selected, as desired, to provide printed images and characters having the characteristics desired.

Binding substrate 20 retains the interspersed distribution of black or colored pigments 22 against elongated backing element 14 prior to the thermal transfer printing operation. In addition, binding substrate 20 retains the uniform interspersed distribution of black or colored pigments 22 once smear resistant thermally transferable printing media 12 is transferred onto paper or some other print receiving medium.

The table below shows a preferred formulation for one preferred embodiment of smear and scratch resistant thermally transferable printing ribbon 10 as shown in FIGS. 1 and 2:

| Ingredient | % Dry Weight | % Dry Range | Grams Dry | Grams Wet |
|---|---|---|---|---|
| Water | | | | 633.5 |
| Isopropyl Alcohol | | | | 112.0 |
| Latex | 16.7 | 10–25% | 33.4 | 87.9 |
| Carnauba Wax | 33.3 | 20–35% | 66.6 | 66.6 |
| Polyethylene Wax | 25.0 | 20–35% | 50.0 | 50.0 |
| Dry Silicone | 25.0 | 15–30% | 50.0 | 50.0 |
| Total | 100.0 | | 200.0 | 1000.0 |

In the above preferred formulation of smear and scratch resistant thermally transferable printing ribbon 10, the isopropyl alcohol used is marketed by Ashland Chemical in Columbus, Ohio; the latex used is marketed as "EC-1052 latex by Environmental Inks in Morganton, N.C.; the carnauba wax used is marketed as "S-Nauba" by Shamrock Technologies Inc. in Newark, N.J.; the polyethylene wax used is marketed as "MPP-620-XF" by Micro Powders, Inc. in Tarrytown, N.Y.; the dry silicone used is marketed as GE-SR342 micro-fine silicone resin by GE Silicones in Waterford, N.Y.; and the backing element used is marketed as "4.5 micron Mylar Polyester Film" by E. I. Dupont de Nemours & Co., Incorporated in Wilmington, Del. Although the dry silicone used in the preferred formulation of smear and scratch resistant thermally transferable printing ribbon 10 described above is GE-SR342 micro-fine silicone resin, GE-SR348 micro-fine silicone resin and GE-SR343 micro-fine silicone resin dry silicones were also tested with acceptable, although less preferred, results.

To fabricate scratch and smear resistant thermally transferable printing ribbon 10, a sub coat layer wax mixture is made for sub coat layer 16 by mixing water, isopropyl alcohol, latex, carnauba wax, polyethylene wax and dry silicone together at ambient room temperature. As an alternative, 100% isopropyl alcohol can be used as a carrier instead of the water and isopropyl alcohol combination in preparing the above sub coat layer wax mixture. In a separate operation, binding substrate 20 ingredients are mixed together and heated to a temperature of 190° F. for thirty minutes. Black or colored pigments 22 are then added to binding substrate 20 ingredients and the resultant printing layer 18 mixture is ground in an attritor for approximately ninety minutes. The wax mixture for sub coat layer 16 is coated onto elongated backing element 14 at a temperature of 140°–150° F. and a dry coat weight of 1.2±0.2 grams per square meter to form sub coat layer 16. In a subsequent operation, printing layer 18 mixture is coated on the surface of sub coat layer 16 distal from elongated backing element 14 at a temperature of 140°–150° F. and a dry coat weight of 2.7±0.5 grams per square meter to form finished smear and scratch resistant thermally transferable printing ribbon 10.

Referring again to FIGS. 1 and 2, the use of smear and scratch resistant thermally transferable printing ribbon 10 in the thermal transfer printing operation will now be described. As seen in FIG. 1, conventional thermal transfer print head, shown schematically as reference numeral 24, is placed in contact with elongated backing element 14 with printing layer 18 of thermally transferable printing media 12 facing and in contact with print receiving medium 26, for example, paper. Portions of thermal transfer print head 24 corresponding to the desired thermally transferred printed image or character 28 are then heated, typically by passing an electrical current through selective resistive elements. This heating is continued until the temperature of binding substrate 20 is above its melting point in those portions corresponding to the desired thermally transferred printed image or character 28. These melted portions of thermally transferable printing media 12 are then transferred onto the adjacent surface of print receiving medium 26, where binding substrate 20 again solidifies. During this transfer operation, binding substrate 20 carries along the interspersed distribution of black or colored pigments 22, which are retained in solidified binding substrate 20, onto print receiving medium 26.

As seen in FIG. 2, once binding substrate 20 has solidified on print receiving medium 26, thermal transfer print head 24 is moved away and elongated backing element 14 is pulled away and separates from thermally transferable printing media 12 in those portions corresponding to the desired thermally transferred printed image or character 28. At this time, thermally transferred printed image or character 28 is fixed on print receiving medium 26.

When thermally transferable printing media 12 of smear and scratch resistant thermally transferable printing ribbon 10 is transferred onto print receiving medium 26, sub coat layer 16 and printing layer 18 are transferred together onto print receiving medium 26. Sub coat layer 16 thus becomes a protective top layer over printing layer 18 and which resists smearing or scratching of thermally transferred printed image or character 28. Thermally transferred printed image or character 28 could include, for example, bar code and/or alphanumeric characters.

Although the present invention has been described above in detail, the same is by way of illustration and example only and is not to be taken as a limitation on the present invention. For example, although the use of thermally transferable printing media 12 having two layers has been described herein, the use of three, or more, layers could be readily accomplished utilizing the teachings of the present invention. Accordingly, the scope and content of the present invention are to be defined only by the terms of the appended claims.

What is claimed is:

1. A thermally transferable printing ribbon, comprising:

a backing element having a top surface;

a sub coat layer adhered to said top surface of said backing element, said sub coat layer including acrylic primer and dry silicone wherein said dry silicone is a micro-fine silicone resin having an average particle size of 0.5–3 microns and said sub coat layer having a top surface distal from said backing element; and a printing layer adhered to said top surface of said sub coat layer, said printing layer including an interspersed distribution of black or colored pigments in a binder.

2. The thermally transferable printing ribbon in accordance with claim 1, wherein said sub coat layer includes carnauba wax.

3. The thermally transferable printing ribbon in accordance with claim 2, wherein said sub coat layer includes polyethylene wax.

4. The thermally transferable printing ribbon in accordance with claim 3, wherein said interspersed distribution of black or colored pigments includes carbon black pigments.

5. The thermally transferable printing ribbon in accordance with claim 4, wherein said interspersed distribution of black or colored pigments includes magnetic identification character recognition (MICR) pigments.

6. The thermally transferable printing ribbon in accordance with claim 4, wherein said interspersed distribution of black or colored pigments includes fluorescent pigments.

7. The thermally transferable printing ribbon in accordance with claim 4, wherein said backing element is an elongated polymeric material.

8. The thermally transferable printing ribbon in accordance with claim 1, wherein said sub coat layer includes polyethylene wax.

9. A thermally transferable printing ribbon, comprising:

a backing element having a top surface;

a sub coat layer adhered to said top surface of said backing element, said sub coat layer including 10 to 25% acrylic primer, 20 to 35% carnauba wax, 20 to 35% polyethylene wax and 15 to 30% dry silicone wherein said dry silicone is selected from a a micro-fine silicone resin having an average particle size of 0.5–3 microns and said sub coat layer having a top surface distal from said backing element; and a printing layer adhered to said top surface of said sub coat layer, said printing layer including an interspersed distribution of black or colored pigments in a binder.

10. The thermally transferable printing ribbon in accordance with claim 9, wherein said interspersed distribution of black or colored pigments includes carbon black pigments.

11. The thermally transferable printing ribbon in accordance with claim 10, wherein said backing element is an elongated polymeric material.

12. The thermally transferable printing ribbon in accordance with claim 9, wherein said sub coat layer includes approximately 16.7% acrylic primer, approximately 33.3% carnauba wax, approximately 25.0% polyethylene wax and approximately 25.0% dry silicone.

13. The thermally transferable printing ribbon in accordance with claim 12, wherein said interspersed distribution of black or colored pigments includes carbon black pigments.

14. The thermally transferable printing ribbon in accordance with claim 13, wherein said backing element is an elongated polymeric material.

15. A thermally transferable printing ribbon, comprising:

a backing element having a top surface;

a sub coat layer adhered to said top surface of said backing element, said sub coat layer including acrylic primer and micro-fine powder silicone resin and said sub coat layer having a top surface distal from said backing element; and a printing layer adhered to said top surface of said sub coat layer, said printing layer including an interspersed distribution of black or colored pigments in a binder.

16. A thermally transferable printing ribbon, comprising:

a backing element having a top surface;

a sub coat layer adhered to said top surface of said backing element, said sub coat layer including 10 to 25% acrylic primer, 20 to 35% carnauba wax, 20 to 35% polyethylene wax and 15 to 30% micro-fine powder silicone resin and said sub coat layer having a top surface distal from said backing element; and a printing layer adhered to said top surface of said sub coat layer, said printing layer including an interspersed distribution of black or colored pigments in a binder.

* * * * *